United States Patent [19]

Laster

[11] 4,332,530

[45] Jun. 1, 1982

[54] PRESSURIZED AIR PUMPING APPARATUS

[76] Inventor: Pat A. Laster, Opelousas, La. 70503

[21] Appl. No.: 116,611

[22] Filed: Jan. 29, 1980

[51] Int. Cl.[3] ..... F04F 1/06

[52] U.S. Cl. ..... 417/130; 417/138

[58] Field of Search ..... 417/126, 130, 136, 138, 417/131

[56] References Cited

U.S. PATENT DOCUMENTS

| | | | |
|---|---|---|---|
| 600,425 | 3/1898 | Johnson | 417/126 |
| 1,321,296 | 11/1919 | Edwards | 417/130 X |
| 1,338,323 | 4/1920 | Muzzy | 417/130 |
| 2,131,183 | 9/1938 | Key | 417/130 X |

*Primary Examiner*—Richard E. Gluck

*Attorney, Agent, or Firm*—Charles C. Garvey, Jr.

[57] ABSTRACT

A pressurized air pumping apparatus for pumping for example drilling mud and like viscous or slurry materials comprises a fluid receiving sump tank having an upper inflow opening and a valve seat at the opening. A discharge conduit at the lowermost portion of the sump tank discharges fluid to be pumped therefrom. A source of compressed air is provided by pressurizing the sump tank and a vertical conduit enters the tank and introduces pressurized air into the interior of the sump tank with the vertical conduit providing a discharge port for entering the compressed air into the sump tank. A valving member is movably mounted in preferably a sliding fashion within the sump tank upon the vertical conduit with the valving member sealing the conduit discharge port in the normal inoperative state while sump tank is receiving by gravity flow for example inflowing fluids to be pumped. The valving member is movable within the sump tank between the first open flow inoperative position to a second closed flow position sealing the inflow opening with the second closed flow position removing the valving member from the discharge port. A float attached to the valving member buoys the valving member upward away from its sealing engagement with the discharge port at which time compressed air entering the sump tank forces the valving member upwardly into a sealing position engaging the inflow opening valve seat. The float moves upwardly responsive to fluid flow into the receiving sump tank. The single compressed air source thus provides both instrumentation and pressure head for pumping.

19 Claims, 7 Drawing Figures

SUMP FILLING

SUMP FULL
INTAKE SEALED-PUMPING BEGINS

SUMP FILLING

CONTINUED FILLING OF SUMP

SUMP FULL
INTAKE SEALED-PUMPING BEGINS

SUMP TANK EMPTY
PUMPING COMPLETE

PRESSURIZED AIR PUMPING APPARATUS

BACKGROUND OF THE INVENTION

The present invention relates to automatically recycling pneumatic pumps. More particularly, the present invention relates to a pneumatic mud pump which automatically begins pumping responsive to the reception by the pump apparatus of an inflow volume of mud, slurry or like fluid to be pumped. Even more particularly, the present invention relates to a pneumatic pumping apparatus for pumping drilling mud, and like thick, difficult to pump slurry fluids in which the valving member alternatively and sequentially seals the compressed air supply for pressurizing the pump and the gravity inflow for adding fluids to the pump, with the single compressed air source providing both instrumentation and pressure head pumping functions.

General Background and Prior Art

In the oil field industry, and especially associated with drilling platforms, drilling rigs and the like, it is known to use a thick viscous fluid known as drilling mud during the proper procedures for drilling wells. The use of drilling mud does produce some problems which are a by-product of its normal beneficial use to the rig. The mud used in drilling is quite thick and difficult to pump or move when it is used up. Waste mud frequently runs off the drilling platform to an area below the rig into what is known in the art as the rig cellar. From the rig cellar, the unwanted mud which is often polluted or too filthy to reclaim must be pumped to a holding pond or pit which is known in the art as a "reserve pit".

Pumps which are known in the art for the pumping of drilling mud and like heavy materials are generally a conventional impeller driven pump. These suffer in that they are inadequate or inefficient in pumping mud as the mud thickens. This is particularly a problem when the weather is quite cold and the mud becomes very thick and difficult if not impossible to transmit from the rig cellar to the reserve pit using conventional pumps. It is not unknown for an oilman or other drilling rig personnel to hand empty the rig cellar using a shovel and bucket when the drilling mud in the cellar becomes so thick that conventional pumps are ineffective in discharging the cellar of the mud and trash which collect there within. It is to this problem that the present invention is directed.

GENERAL DISCUSSION OF THE PRESENT INVENTION

The present invention solves these prior art problems and shortcomings in a simple and straight forward and inexpensive manner. The present invention provides a pump assembly which comprises a tank sump into which drilling mud can be taken as for example by gravity flow through a provided upper tank inflow. A tank discharge is also provided for transmitting mud collected within the sump tank through the discharge line to a desired point removed therefrom. The tank provides an uppermost trash cage of disallowing the entry of bulk trash items to the pump. Within the tank sump is provided a valving member which moves between open flow and closed flow positions. The valve member normally rests upon and seals the compressed air supply conduit which provides an inner discharge port for conveying compressed air to the interior of the sump tank. The valving member is weighted and normally retains a sealed position upon the compressed air conduit disallowing the flow of pressurized or compressed air into the inner pressure chamber portion of the sump tank. Responsive to the accumulation of fluids within the tank sump, the valving member is dislodged and separated from the compressed air supply conduit, allowing compressed air to enter the inner chamber portion of the sump tank. This is accomplished, because the valving member is equipped with a float section which, responsive to the entry of fluids to the sump tank is buoyed and loses its sealing effect on the compressed air conduit. The removal of the valving member from the compressed air conduit is an explosive movement, because a telescoping arrangement mounts the valve assembly on the compressed air conduit. Thusly, a telescoping chamber provided therebetween causes the initial volume of compressed air entering the sump tank to power the valving member upwardly until a seal is effected between the valving member upper seal and the gravity inflow to the sump tank. Once this seal is achieved, a flow commences between a clearance provided between the telescoping portions of the valving member and the inflow conduit for compressed air. Once the tank is pressurized, fluid flow proceeds through the discharge provided at the sump tank bottom portion. It will be appreciated that a desired buildup of pressure can be achieved using a sump tank of suitable pressure requirements and a source of compressed air sufficient to move any fluid even, heavy viscous drilling mud, slurries, oil, and the like.

It is thus an object of the present invention to provide a pump apparatus useful in the pumping of drilling mud, oil, slurries, and the like.

It is another object of the present invention to provide a pump apparatus which is simple in operation, easy to maintain, and easy to construct and install. Another object of the present invention is to provide a pneumatic apparatus which pumps fluid materials by the use of pneumatic force.

Another object of the present invention is to provide a pump apparatus having a valving member which is operable between open flow and closed flow positions by a source of compressed air supply to the valving member. Another object of the present invention is to provide an automatic pumping apparatus which automatically begins the pumping operation responsive to the accumulation of fluids within the pumping chamber, and without the use of external sensors to begin the pumping cycle.

Another object of the present invention is to provide an entirely pneumatic pumping apparatus in which the pump drive force as well as the valve operation is accomplished with a single source of compressed air supplied at a constant desired operation pressure.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
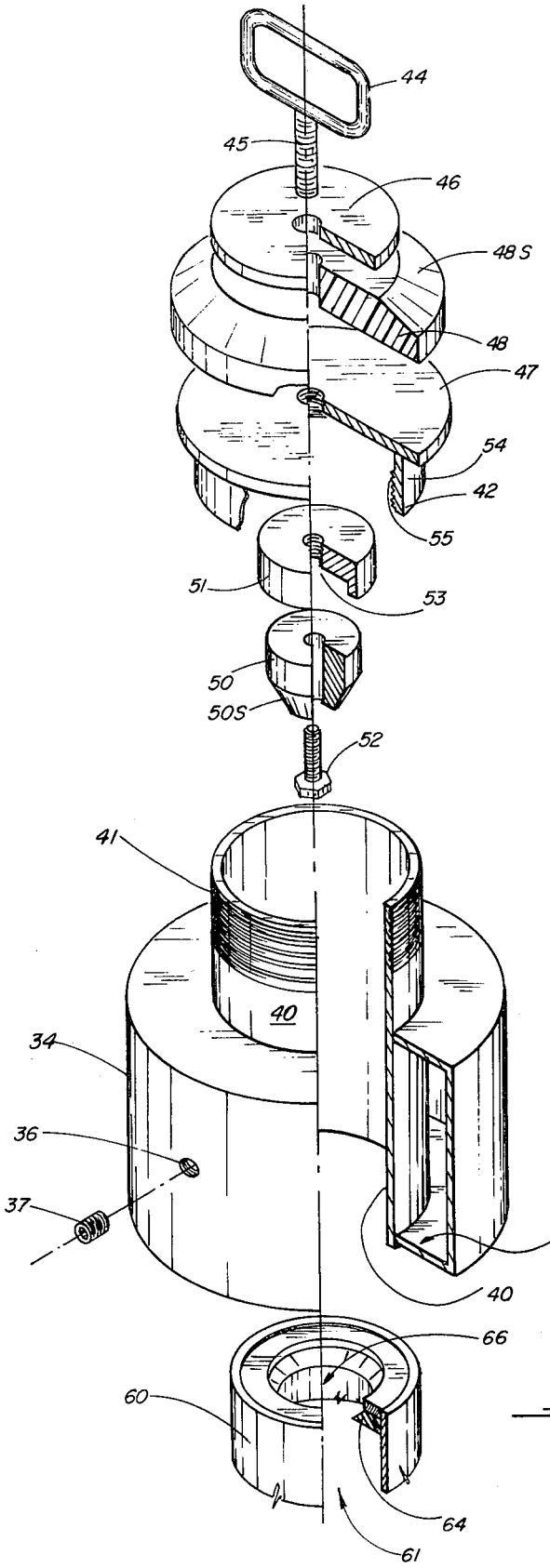
FIG. 1 is an exploded perspective view of the valving member portion of the preferred embodiment of the apparatus of the present invention.
Figure 2:
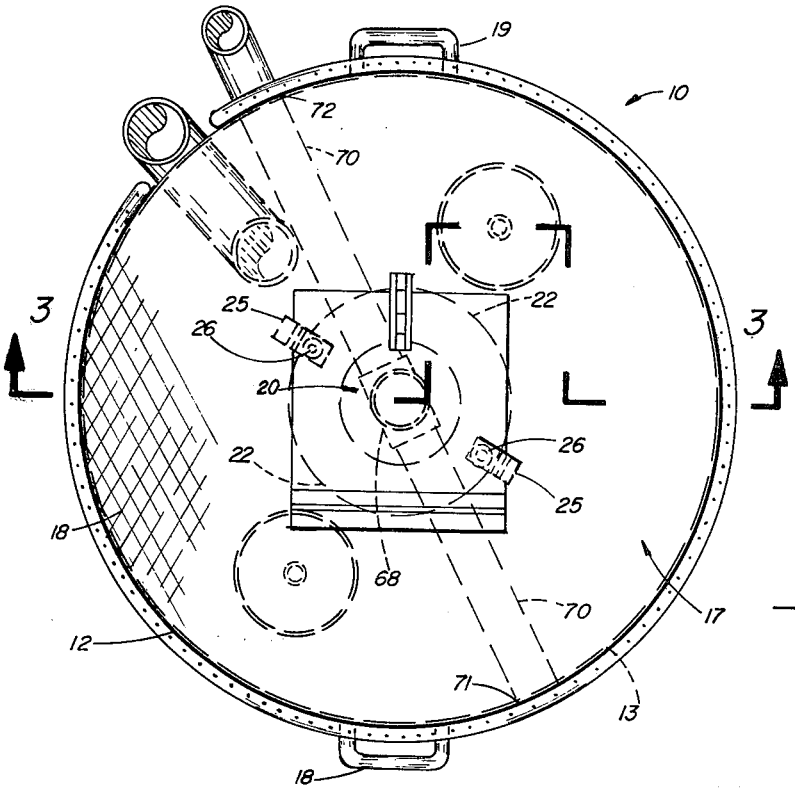
FIG. 2 is a top sectional view of the preferred embodiment of the apparatus of the present invention.
Figure 3:
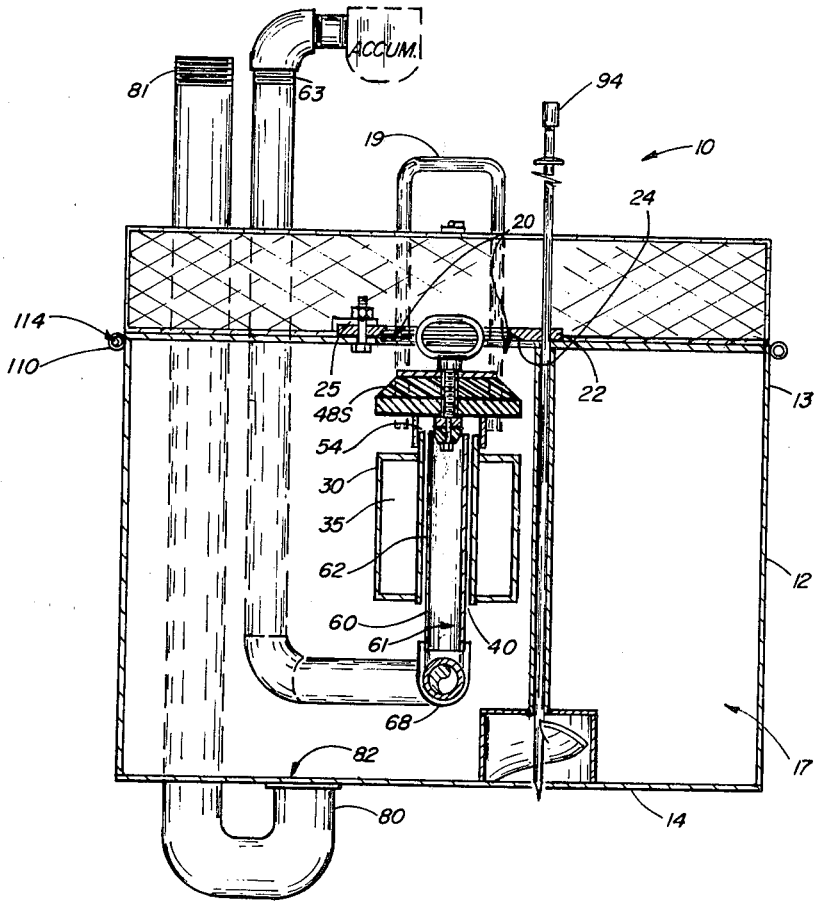
FIG. 3 is sectional view of the preferred embodiment of the apparatus of the present invention taken along lines 3—3 of FIG. 2.

FIGS. 1–3 best illustrate the preferred embodiment of the apparatus of the present invention designated generally by the numeral 10. In FIGS. 1–3, there can be seen pump apparatus 10 which is comprised generally of sump tank 12 which can be pressurized as will be described more fully hereinafter, an inner pressure chamber 17, a compressed air supply conduit 60 for pressurizing the sump tank 12, and a valving member 30 (see FIG. 1) which moves between open flow and closed flow positions to alternatively and sequentially seal intake 20 (which can be for example a gravity flow fluid intake, and compressed air discharge opening 66. The operation of valving member 30 will be discussed in detail with regard to FIG. 3 then with regard to sequential views 4A–4D which illustrate the sequential pumping cycle of valve 10.

Tank 12, as best seen in FIG. 3, is in the preferred embodiment cylindrical providing a cylindrical tank sidewall 13, a tank bottom 14, and a tank lid 16. Pressurized sump tank 12 could be for example of welded steel construction, using wall thicknesses sufficient for the pressures desired in a given operation. In the preferred embodiment, tank 12 would be of welded construction using wall thicknesses to withstand pressures of, for example, 0–200 psi. Once so assembled, tank 12 provides an inner pressure chamber 17 which can be sealed at intake 20 by a valving member 30 as will be discussed more fully hereinafter. Intake 20 provides a gravity inflow, as pump tank 12 would normally be sunk or buried and fluids would be accumulated above intake 20 and flow into tank 12 through intake 20 when open.

A trash cage 18 is provided on the upper portion of sump tank 12, being cylindrical in construction and attaching by means of brackets 25 and bolts 26 to the lid 16 portion of tank 12. Screen 18 would be of expanded metal construction for example having a small enough mesh size to prevent particles from entering tank 12 which would be too large to pass through tank effluent discharge 82.

Tank 12 could also be provided with pad eyes 19 as seen in FIGS. 2 and 3 for lifting and carrying tank 12 if desired.

Intake 20 provides a seat 22 which is bevelled as best seen in FIG. 3. Bevelled seat 22 provides a bevelled face seal 24 which is circular in shape and is adapted to mate with valving member 30 at intake closure valve surface **48*s*. The bevelled surface of intake closure valve surface 48*s* and the corresponding surface of bevelled face seal 24 provide mating surfaces which accomplish a good seal which allows inner chamber 17 to be pressurized responsive to the introduction of compressed air thereinto. A sparger 110 having internal bore 114 surrounds lid 16 of tank 12. Discharge openings 112 are spaced along sparger 110. Sparger 110 helps clean trash from about screen 118** at the side portions thereof.

FIG. 1 illustrates more particularly the construction of valving member assembly 30.

Valving member assembly 30 is comprised generally of lower float section 34 and upper weighted section 42. Float section 34 provides a float chamber 35 having a provided opening 36 with a sealing plug 37. This allows fluid or other weighted material to be added to the interior of float chamber 35 to thus provide an adjustability to the buoyant force provided by float chamber 35. It will be appreciated by one skilled in the art, that the addition of fluid into float chamber 35 will displace air and cause a different buoyant effect.

The innermost portion of float section 34 provides a valve travel guide sleeve 40 which is cylindrical having upper male threads 41. Valve travel guide sleeve 40 is of a greater diameter than conduit 60 as is illustrated in FIGS. 1 and 3. Note that a clearance 62 is provided therebetween through which compressed air can travel into tank chamber 17.

Upper weighted section 42 provides an uppermost handle 44 having handle threads 45. A pair of spaced weighted discs 46, 47 are provided having therebetween bevelled intake closure valve 48. Bevelled intake closure seal 48 provides a sealing surface 48S which is bevelled which cooperates with and seals against the provided bevelled face seat 24 of bevelled seat 22.

Lowermost disc 47 provides a female threaded socket 49 which allows the lower handle threaded portion of handle 44 to threadably engage thereto providing for an assembly of handle 44, discs 46, 47 and closure seal 48.

Discs 46, 47 can be of steel, cast iron, or metal construction, and can be sufficiently thickened to provide a desired weight to valving member 30. Depending from lowermost disc 47 and attached thereto by welding for example is cylindrical hanger 54 having internal female threads 55. Threadably engaged into hanger 55 are both conduit seal mount 51 and valve travel guide sleeve 40. The male threads 41 of valve travel guide sleeve 40 threadably engage with the female threads 55 of hanger 54 as best seen in FIGS. 1 and 3.

A second bevelled seal is provided on valving member 30. That is compressed air conduit seal 50 which provides also a bevelled seal surface 50S which is downwardly depending as opposed to the upwardly depending surface 48S of upper seal 48. Conduit seal 50 forms a seal over upper conduit seat 64 of compressed air supply conduit 60. Thus, the seat opening 66 is closed disallowing the discharge of compressed air from compressed air conduit bore 61 through opening 66. Seal 50 is attached to seal mount 51 by the use of bolt 52 which can be tooled for receiving a desired tool tip portion such as an allen wrench or the like. In this manner the necessary torque can be applied through a suitable tool such as an allen wrench two-bolt 52 which allows it to be threadably engaged into conduit seal mount 51 at threads 53.

Compressed air supply conduit 60 is preferably vertically disposed provided an inner bore 61 with a clearance 62 being provided between conduit 60 and valve travel guide sleeeve 40. This clearance is important, because an initial volume of compressed air entering pressure chamber 17 at opening 66 will first power valving member 30 upwardly until a seal is perfected between upper seal 48 and gravity inflow 20 at surface 24. Once this seal is perfected, a continued flow of compressed air into chamber 17 (as is necessary to pressurize same) will be between conduit 60 and valve travel guide sleeve 40 at the provided clearance 62.

It will be appreciated from the above that a telescoping arrangement is provided between valve travel guide sleeve 40 and conduit 60 upon which it normally rests. Thus, a guided travel path is provided for valving member 30 which will automatically register it in the lowermost position in such a way that seal 50 covers and seals seat 64. After an uppermost travel, guide sleeve 40 will channel the upward path of valving member 30 to perfect a seal between upper seal 48 and surface 24. Even when valving member 30 is in its highest position, there will still be a telescopic guiding arrangement and connection between valve travel guide sleeve 40 and conduit 60. A registered, guided telescopic arrangement is provided. It will be appreciated, that once a buoyant force overcomes the weighted pressure holding valving member 30 onto conduit 60, air will be allowed to discharge through seat opening 66. This will be an explosive discharge, since once static forces are overcome, compressed air will rapidly fill a space between conduit seal mount 51 and opening 66 and will pressurize this space firstly providing the explosive driving force necessary to power valving member 30 upwardly into its sealing arrangement with intake 20.

Conduit 60 provides a conduit tee 68 having laterally extending conduits support pipe member 70 as best seen in FIG. 2. This arrangement provides excellent support for conduit 60 at the critical valving location. Conduit lateral support pipe 70 can be welded for example at points 71, 72 to cylindrical tank wall 13.

A pump discharge line 80 is provided having threads 81 which allow it to be connected to any other conveying hose or the like to convey discharged liquids to for example a reserve pit in the case of drilling mud. Anchor assemblies 90 would allow sump tank to be anchored in soil if buried. In FIGS. 2–3, two anchor assemblies are seen. Each anchor assembly 90 provides a shaft 100 having anchor rod 92 slideably mounted therein. An upper handle could be a circular (square or hexagonal for example) allowing a wrench to attach thereto so rotation could be imparted to shaft 92. A lower auger 96 would be housed within auger housing 99 with a downwardly facing opening 102 allowing auger and shaft 92 to move downwardly into an underlying soil mass. Compressed air conduit 60 can provide threads 63 for allowing the connection of rig air thereto or a like suitable source of compressed air.

Figure 4A:
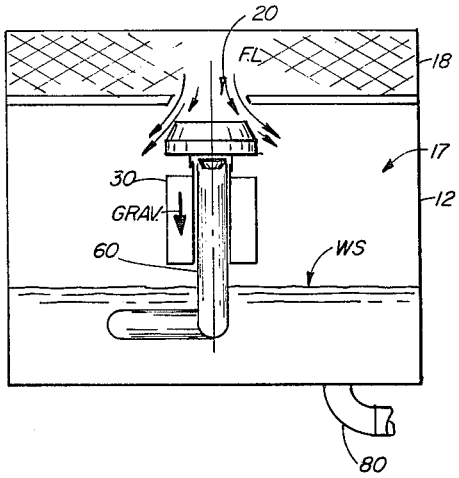
FIGS. 4A–4D are sequential views illustrating the pump cycle of the preferred embodiment of the apparatus of the present invention.

FIGS. 4A–4D are sequential views which illustrate the pumping sequence. In FIG. 4A, sump 12 is schematically illustrated receiving fluid flow through intake 20. In the preferred embodiment, tank 12 would normally be sunk or buried for example in the rig cellar of a drilling rig which drilling mud would be the fluid being pumped. Other similar varied applications could of course be utilized. In FIG. 4A, arrows F-L schematically illustrate the flow fluids into tank 12 interior 17. W-S indicates the water surface or fluid surface within tank 12 in the early stage of the pumping cycle as shown in FIG. 4A. Note that valve 30 is in its normal inoperative position upon conduit 60 with the downward gravitational force upon valve 30 forming a seal of valve 30 upon conduit 60. In FIG. 4A, the flow of compressed air into tank interior 17 is valved and stopped. The gravitational force upon valve 30 is schematically illustrated by the letters GRAV.

Figure 4B:
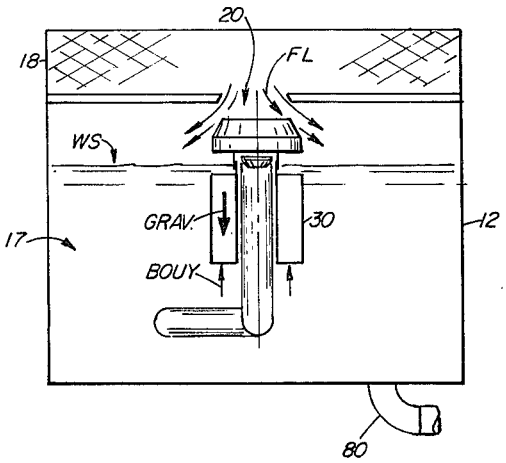

In FIG. 4B, water surface or fluid surface, WS, has significantly risen in tank 12. In FIG. 4B, the gravitational force upon valve 30 is somewhat counteracted by the buoyant force illustrated by the arrow buoy. As the fluid level rises, the buoyant force buoy increases responsive to the rising fluid level.

Figure 4C:
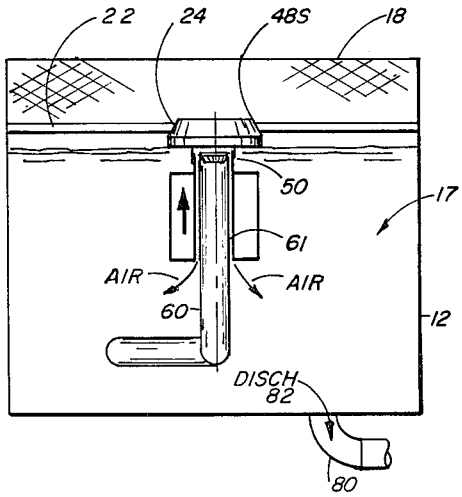

In FIG. 4C, the fluid level, WS, has substantially filled tank 12. At this time, the static force of valve 30 has been overcome by the buoyant force of the fluid contained within tank 12. Note that compressed air supplied through conduit 60 has now powered valve 30 upwardly and valving surface 48S now seals against bevelled seat 22 at bevel seat surface 24. Arrows "AIR" schematically illustrate the continuing inflow of compressed air through conduit 60 into tank 12 interior 17. As aforementioned, the flow into tank interior 17 is between guide sleeve 40 and conduit 60 at the provided clearance 62 therebetween. The inflow of compressed air as schematically illustrated in FIG. 4C will now pressurize tank 12 to have a compressed air inner pressure substantially equal to the pressure of the available source of compressed air which flows through conduit 60. An accumulator or like auxiliary tank (not shown) could be utilized to store large amounts of compressed air. An accumulator is schematically shown in FIG. 3 as attached to conduit 60 at threads 63.

Figure 4D:
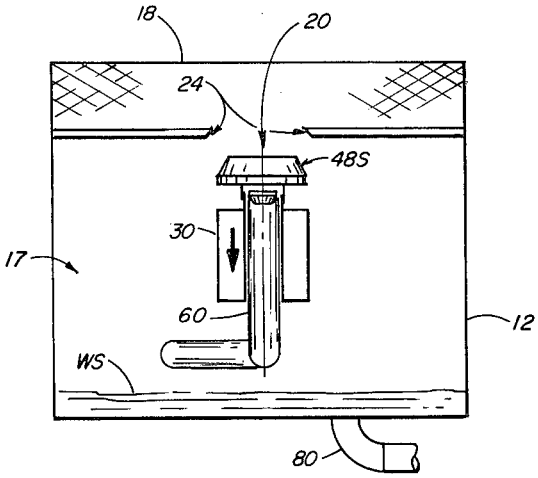

In FIG. 4D, water surface WS has substantially dropped as fluids have been discharged through a discharge line 80. Once all fluids have been pumped from tank 12, a pressure drop will be achieved as compressed air exits through discharge 80. Responsive to this pressure drop, a valve 30 will fall since no buoyant force is now acting on valve 30 as all fluids have been discharged from tank 12. Thus, valve 30 now assumes its inoperative sealing position over conduit 60 to again allow the flow by gravity for example of fluids into sump 12 through intake 20. Simultaneous with the sealing of conduit 20 is the opening of intake 20 and the disengagement of valve surface 48S with bevelled surface 24.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A pressurized air pumping apparatus comprising:

a. a fluid receiving sump tank;

b. an inflow opening having a valve seat;

c. discharge conduit means for discharging fluid from said sump tank;

d. a source of compressed air for pressurizing said sump tank and connectable thereto;

e. conduit means for introducing pressurized air into the interior of said sump tank, said conduit means providing discharge port means for transmitting compressed air from said conduit means into said sump tank, said discharge port means being disposed within the confines of said tank;

f. valving member means movably mounted within said sump tank between said seat and said discharge port means for sequentially sealing said conduit means at said discharge port means during the filling of said tank, and said inflow opening at said valve seat during the discharge of fluids from said tank, said valving member means being movable within said sump tank between a first open flow position removed from said seat and said inflow opening allowing fluid flow into said tank, simultaneously sealing said discharge port means, and a second closed flow pumping position sealing said inflow opening but removed from said discharge port allowing compressed air to fill and pressurize said tank at said closed flow pumping position; and g. float means attached to said valving member means and moving therewithin for buoying said valving member responsive to the addition of fluid to be pumped to said sump tank, the buoying of said valving member urging said valving member toward said closed flow position.

2. The apparatus of claim 1 wherein said valving member means comprises in part a pair of valve surfaces, including an upper valve surface adapted to sealably engage and seal said valve seat, and a lower valve surface adapted to engage and seal said discharge port means.

3. The apparatus of claim 1 wherein said valving member means assumes said open flow position sealing said conduit at said discharge port means in the absence of fluid within said tank.

4. The apparatus of claim 1 wherein said conduit means normally conveys compressed air, and said valving member means normally assumes a sealing position upon said vertical conduit means, sealing said discharge port means.

5. The apparatus of claim 1 wherein said valving member means comprises a valving member carried slidably upon said conduit means which guides said valving member between said open and closed positions and gravitational pull urges said valving member means into said first open flow position at which said valving member seals said conduit at said discharge port means.

6. The apparatus of claim 1 wherein said float means is a float attached to said valving member, and said float urges said valving member towards said inflow opening and disengagement with said discharge port means responsive to the continued introduction of a fluid stream to be pumped into said sump tank.

7. The apparatus of claim 1 further comprising means associated with said sump tank for depressurizing said sump tank responsive to the discharge of a fluid stream contained within said sump tank from said sump tank through said discharge conduit.

8. The apparatus of claim 1 wherein said source of compressed air is an accumulator tank connected to said vertical conduit means and supplying said vertical conduit means with compressed air.

9. The apparatus of claim 1 wherein said inflow opening provides a bevelled valve seat and said valving member provides a corresponding bevelled valve surface with said valving member and said valve seat registering and temporarily abutting together to seal said sump tank at said closed flow pumping position allowing said sump tank to be pressurized by said source of compressed air.

10. A pneumatic pumping apparatus, comprising:

a. a sealable, pressurizable, sump tank having an upper lid portion and a bottom portion and a continuous sidewall connecting said lid and bottom portions and defining therewithin an inner pressure chamber;

b. an inflow opening provided on said upper lid portion, allowing gravity flow of fluids into said tank pressure chamber therethrough;

c. an inflow seat at said inflow opening;

d. discharge conduit means for discharging fluids from said inner pressure chamber;

e. compressed air conveying convening conduit means for conveying a volume of compressed air to said tank chamber, said conduit means comprising in part a vertically oriented conduit disposed within said pressure chamber and providing an upper end defining an air discharge opening, and a sealing surface about said opening;

f. a valve member slidably movable upon said vertically oriented conduit, said valve member comprising:

a valve body, an upper inflow sealing valve member on said valve body, a lower conduit sealing valve member on said valve body, float means carried by and movable with said valve body for buoying said valve member responsive to the accumulation of fluids within at least a portion of said pressure chamber; and g. instrumentation means for moving said valve member between open flow and closed flow pumping positions, said instrumentation means placing said valve member in said open flow position at least when said tank is substantially empty and said instrumentation means placing said valve member in said closed flow pumping position when said tank is filled with a fluid to be pumped.

11. A pneumatic pumping apparatus comprisng:

a. a pressurizable pumping tank;

b. a gravity flow inlet on the upper portion of said tank for admitting a fluid to be pumped;

c. a compressed air conveying conduit disposed at least in part within the confines of said tank; said conduit providing a vertical end section terminating at an air discharge port, the axis of said conduit vertical end section generally intersecting the center of said inlet;

d. a valving member having a central opening which registers with said conduit vertical end section slidably mounting said valving member thereupon;

e. valve surface on said valving member which seals said discharge port when said valving member rests upon said conduit discharge port as when said tank is substantially void of fluid being pumped;

f. an upper valve surface on said valving member;

g. a float carried by said valving member;

h. instrumentation means comprising at least in part a source of compressed air transmitted to said tank through said conduit for urging said valving member toward said float by rising fluid within said tank; and i. discharge outlet means at the bottom of said tank for discharging fluids from said tank.

12. The apparatus of claim 11 wherein said valving member provides a pair of resilient seal members placed respectively on the upper and lower surfaces of said valving member; said resilient seal members providing respectively said upper and said lower valve surfaces.

13. The apparatus of claim 11 further comprising an accumulator connectable pneumatically to said conduit.

14. The apparatus of claim 12 wherein said flow inlet and said upper resilient seal member are generally round and correspondingly sized with said seal member registering with said opening during closure thereof by said valving member.

15. The apparatus of claim 11 wherein said valving member provides a cylindrical sleeve which registers with and slides upon said vertical end section of said conduit.

16. The apparatus of claim 15 wherein said float is generally cylindrical, circumventing and attaching to said valving member at said sleeve.

17. The apparatus of claim 11 wherein said discharge outlet provides a discharge pipe beginning at said outlet and extending upwardly at least above said flow inlet.

18. The apparatus of claim 11 wherein said valving member is slidably mounted upon said conduit and within the confines of said tank along a vertical path of travel defined by respective filling and pumping end positions at which said valving member respectively seals said air discharge port and said flow inlet.

19. The apparatus of claim 18 wherein said valving member effects a seal of said air discharge port by its own weight in the absence of fluid buoying said float.

* * * * *